US007183882B2

(12) United States Patent
Ko et al.

(10) Patent No.: US 7,183,882 B2
(45) Date of Patent: Feb. 27, 2007

(54) MICROSTRIP BAND PASS FILTER USING END-COUPLED SIRS

(75) Inventors: Kyoung Suk Ko, Chungcheongbuk-Do (KR); Dong Suk Jun, Daejeon-Shi (KR); Dong Young Kim, Dajeon-Shi (KR); Hong Yeol Lee, Chungcheongbuk-Do (KR); Sang Seok Lee, Daejeon-Shi (KR)

(73) Assignee: Electronics and Telecommunications Research Institute, Daejeon-shi (KR)

( * ) Notice: Subject to any disclaimer, the term of this patent is extended or adjusted under 35 U.S.C. 154(b) by 29 days.

(21) Appl. No.: 10/919,332

(22) Filed: Aug. 17, 2004

(65) Prior Publication Data

US 2005/0140472 A1 Jun. 30, 2005

(30) Foreign Application Priority Data

Dec. 24, 2003 (KR) ..... 10-2003-0096032

(51) Int. Cl.
*H01P 1/203* (2006.01)

(52) U.S. Cl. ..... 333/204; 333/219

(58) Field of Classification Search ..... 333/204, 333/205, 219

See application file for complete search history.

(56) References Cited

U.S. PATENT DOCUMENTS 4,371,853 A * 2/1983 Makimoto et al. ..... 333/204
4,506,241 A 3/1985 Makimoto et al.
5,101,181 A * 3/1992 Rauscher ..... 333/134
5,144,268 A 9/1992 Weidman
6,771,147 B2 * 8/2004 Mongia ..... 333/204

FOREIGN PATENT DOCUMENTS

JP 11355009 A * 12/1999
WO 99/18629 4/1999

OTHER PUBLICATIONS

Makimoto et al., "Bandpass Filters Using Parallel Coupled Stripline Stepped Impedance Resonators", IEEE Trans. on Microwave Theory 7 Tech. vol. MTT-28, No. 12, Dec. 1980, pp. 1413-1417.*
Sagawa et al., "A Design Method of Bandpass Filters Using Dielecrtic-Filled Coaxial Resonators", IEEE, Feb. 1985, pp. 152-157.

* cited by examiner

*Primary Examiner*—Seungsook Ham
(74) *Attorney, Agent, or Firm*—Mayer Brown Rowe & Maw LLP

(57) ABSTRACT

The present invention relates to a microstrip band pass filter and, more specifically, to a microstrip band pass filter using end-coupled stepped impedance resonators that can be used in a millimeter wave band, wherein the microstrip band pass filter comprises: a dielectric substrate; a conductor plate located on a lower surface of the dielectric substrate; and an input terminal, a plurality of SIRs and an output terminal located on an upper surface of the dielectric substrate in series, wherein the input terminal, the plurality of SIRs and the outputs terminal are conductors and end-coupled through gaps, whereby the microstrip band pass filter has a good attenuation characteristic and a narrowband characteristic, and is insensitive to the manufacturing error, and a fine frequency transition can be made without distortion just with width adjustment of the low impedance transmission line of the SIR.

2 Claims, 8 Drawing Sheets

60 GHz Bandpass Filter

MICROSTRIP BAND PASS FILTER USING END-COUPLED SIRS

BACKGROUND

1. Field of the Invention

The present invention generally relates to a microstrip band pass filter. More specifically, the present invention relates to a microstrip band pass filter using end-coupled stepped impedance resonators (hereinafter, referred to as "SIR") that can be used in a millimeter wave band.

2. Discussion of Related Art

A microstrip line represents a transmission line that has a pair of conductive thin films at both sides and a dielectric substrate therebetween. It is also referred to as "microstrip transmission line". The upper conductor has a designated shape (strip type) and the lower conductor is formed of a wide ground conductor. Further, there can exist an up-down symmetrical structure where another dielectric is located on the upper conductor. The SIR is a resonator that transmits a signal in a specific frequency band and blocks signals in other frequency bands based on the impedance ratio and length of the microstrip line.

As a filter using the conventional SIR, a type of using a dielectric coaxial line and a planar type of a printed circuit are mainly used.

Among these, most of the dielectric coaxial line types, which are original filters that use the SIR, generate a capacitance through a metal structure to make a filter using a two-step SIR, which are appropriate for high output power and are typically used in a low frequency range such as below several GHz.

For the planar type of the printed circuit, there generally exist a strip line, a microstrip line and a coplanar waveguide (hereinafter, referred to as "CPW"). Among these, a filter using the strip line and the microstrip line employs a three-step SIR to connect the coupling structure between resonators to the parallel coupling line, which has been mainly reported in a frequency band below 10 GHz. A filter using the CPW employs a two-step SIR to connect the coupling structure between resonators using a gap and a ground, which has been reported in a frequency band below 300 GHz.

Most of the conventional planar type filters using the SIR are coupled to the resonators through the coupling line, which have been used in a frequency band below 10 GHz. Further, since a capacitance of the coupling line is changed together with an even mode impedance and an odd mode impedance according to the gap, it is sensitive to the manufacturing process error and it is difficult to have good attenuation and narrowband characteristics. Therefore, the conventional planar type filters using the SIR are required to have the good attenuation and narrowband characteristics, and as the filter structures becomes smaller proportional to a wavelength, there occurs a problem that it is not suitable for use in the millimeter wave band (30 GHz to 300 GHz) that requires an insensitive characteristic to the small manufacturing process error. Further, contrary to the filter that has been used in the frequency band below 10 GHz, the filter of the millimeter wave band should consider the parasitic component caused by the discontinuous structure.

SUMMARY OF THE INVENTION

The present invention is directed to a microstrip band pass filter that has a good attenuation characteristic and a narrowband characteristic, and is insensitive to a manufacturing error and makes a fine frequency transition without distortion of the filter characteristics just with width adjustment of the low impedance line of the SIR.

The present invention is also directed to a microstrip band pass in which a parasitic component value due to a discontinuous structure of the SIR is extracted using an analysis theory for the existing discontinuous structure to increase or reduce the length of the resonator for compensation, thus having a merit that various frequency ranges are applicable with improved design accuracy.

One aspect of the present invention is to provide a microstrip band pass filter comprising: a dielectric substrate; a conductor plate located on a lower surface of the dielectric substrate; and an input terminal, a plurality of SIRs and an output terminal located on an upper surface of the dielectric substrate in series, wherein the input terminal, the plurality of SIRs and the outputs terminal are conductors and end-coupled through gaps.

BRIEF DESCRIPTION OF THE DRAWINGS

The above and other features and advantages of the present invention will become more apparent to those of ordinary skill in the art by describing in detail preferred embodiments thereof with reference to the attached drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art.

Figure 1:
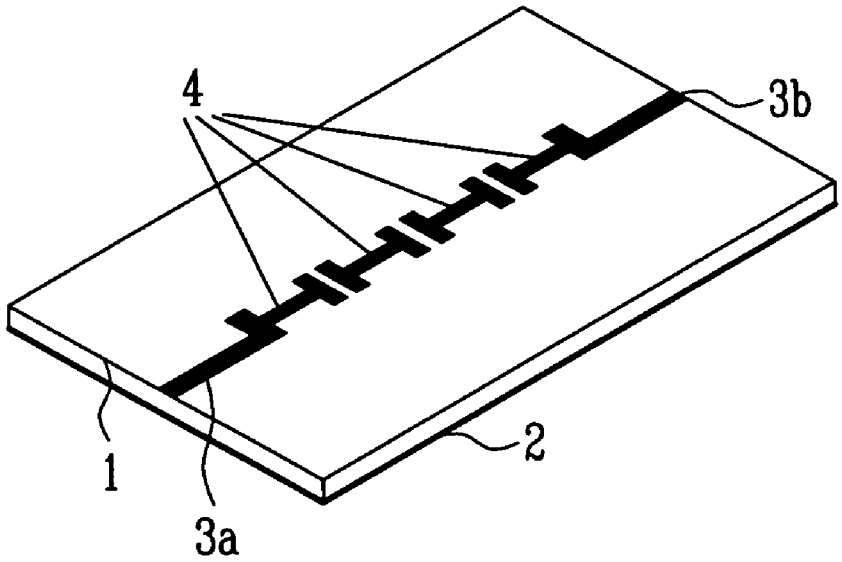
FIG. 1 is a structural diagram of a microstrip band pass filter according to a first embodiment of the present invention.

FIG. 1 is a structural diagram of a microstrip band pass filter according to a first embodiment of the present invention. In FIG. 1, the microstrip band pass filter comprises a dielectric substrate 1, a conductive plate 2 arranged on a lower surface of the dielectric substrate, input and output terminals 3*a*, 3*b* located on an upper surface of the dielectric substrate in series and made of a conductor, and a plurality of SIRs 4. That is, the conductive input and output terminals 3*a*, 3*b* and the plurality of SIRs 4 are arranged in a length direction of the transmission line of the SIR 4. However, this does not mean that the conductive input and output terminal should be arranged in the length direction of the transmission line of the SIR 4. Further, the input and output terminals 3*a*, 3*b* and the plurality of SIRs 4 are end-coupled by a gap. That is, both ends of the band pass filter are capacitively coupled by the gap. The SIR 4 is a three step SIR 4 using a microstrip line. That is, both ends of the SIR 4 are low impedance transmission lines, and its center is a high impedance transmission line. An order, that is, the number of the SIRs 4 is determined according to an attenuation requirement of the filter. When the signal is applied to the input terminal 3*a*, the signal is transmitted to the SIR 4 with a capacitive coupling by the gap, and then, the signal is outputted to the output terminal 3*b* via the SIR 4. Here, the transmitted frequency band is determined based on the gap size and the structural value of the SIR 4 serving as a band pass filter.

Figure 2:
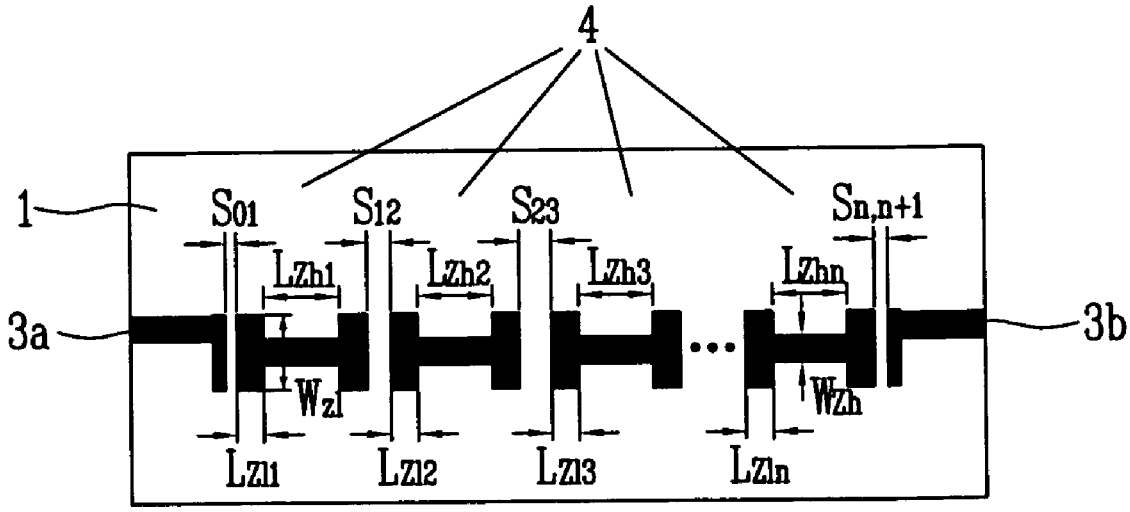
FIG. 2 is a plan view of the microstrip band pass filter shown in FIG. 1.

FIG. 2 is a plan view of a microstrip band pass filter shown in FIG. 1, which illustrates components in configuring the band pass filter of the present invention. In FIG. 2, reference numerals 1, 3*a*, 3*b*, and 4 indicate a dielectric substrate, an input terminal, an output terminal and an SIR, respectively. $S_{01}$ indicates a gap size between the input terminal 3*a* and the first SIR, $L_{Z11}$ indicates a length of a low impedance transmission line of the first SIR, $L_{Zh1}$ indicates a length of a high impedance transmission line of the first SIR, and $W_{Z1}$ indicates a width of the low impedance transmission line of the SIR.

The SIR can implement a filter that has a narrowband characteristic and an improved attenuation characteristic due to its end-coupled structure. This is because the SIR is coupled by an electric field when end-coupled, in which the electric field intensity leads to the narrowband characteristic in terms of a structure. Further, due to the energy conservation law, it has a characteristic that, an unnecessary frequency band attenuation increases for a narrowband while the attenuation does not increase for a wideband. Additionally, a frequency transition can be made without distortion only with the width adjustment of the low impedance line of the SIR, thus facilitating tuning. This is because when the width is adjusted, the length of the low impedance line is changed in the electrical meaning, which is far smaller value than the length for the case where the length of the low impedance line is directly adjusted, thereby adjusting an exact amount of the frequency transition. In addition, in the millimeter wave range, a very little change of the value can lead to a significant change in the filter characteristics, thus facilitating width adjustment tuning.

FIGS. 3 to 6 are diagrams for illustrating a parasitic component value due to a discontinuous structure of the SIR and compensation thereof.

Figure 3:
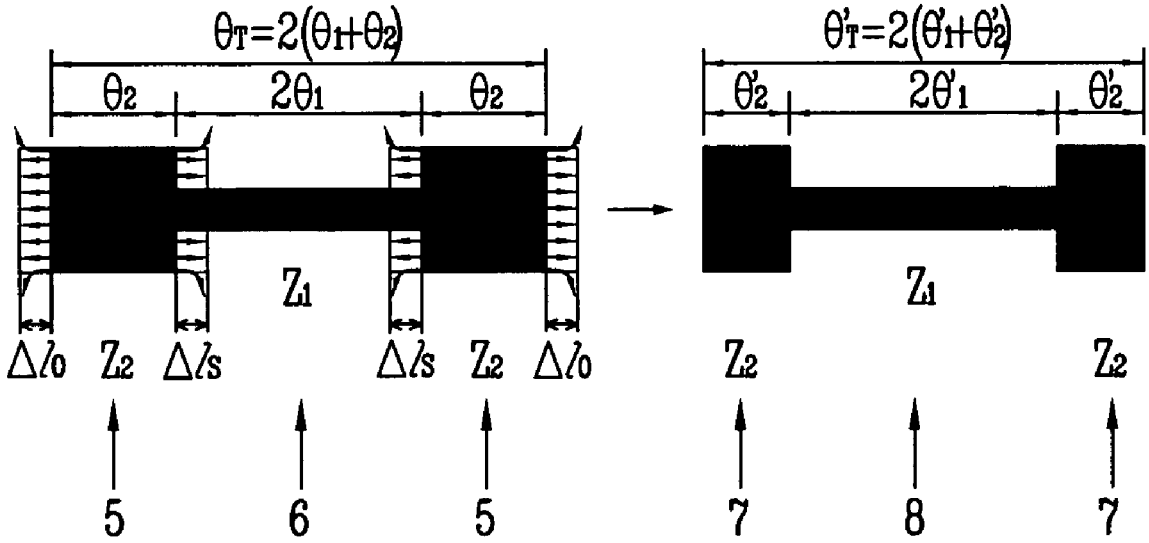
FIGS. 3 to 6 are diagrams for illustrating a parasitic component value due to a discontinuous structure of the SIR and compensation thereof.

FIG. 3 is a structural diagram for existing SIRs 5, 6 and SIRs 7, 8 in which parasitic components values are extracted to compensate the length. In FIG. 3, the existing SIRs 5, 6 have an effect from an open type terminal $\Delta \mathbf{1}_0$, and an effect from a step $\Delta \mathbf{1}_S$. The effect from the open type terminal $\Delta \mathbf{1}_0$ electrically increases the length of the low impedance transmission line to transit to a frequency range lower than a desired one, and the effect from the step $\Delta \mathbf{1}_S$ electrically increases the length of the low impedance transmission line as well as reduces the length of the high impedance transmission line, so that a characteristic of the desired frequency range can be obtained. Therefore, the SIRs 7, 8 compensated with this reduce the length of the low impedance transmission line $\theta'_2$ as much as the effect from the open type terminal $\Delta \mathbf{1}_0$ and the effect from the step $\Delta \mathbf{1}_S$, and increase the length of the high impedance transmission line $\theta'_1$ as much as the effect from the step $\Delta \mathbf{1}_S$.

Figure 4:
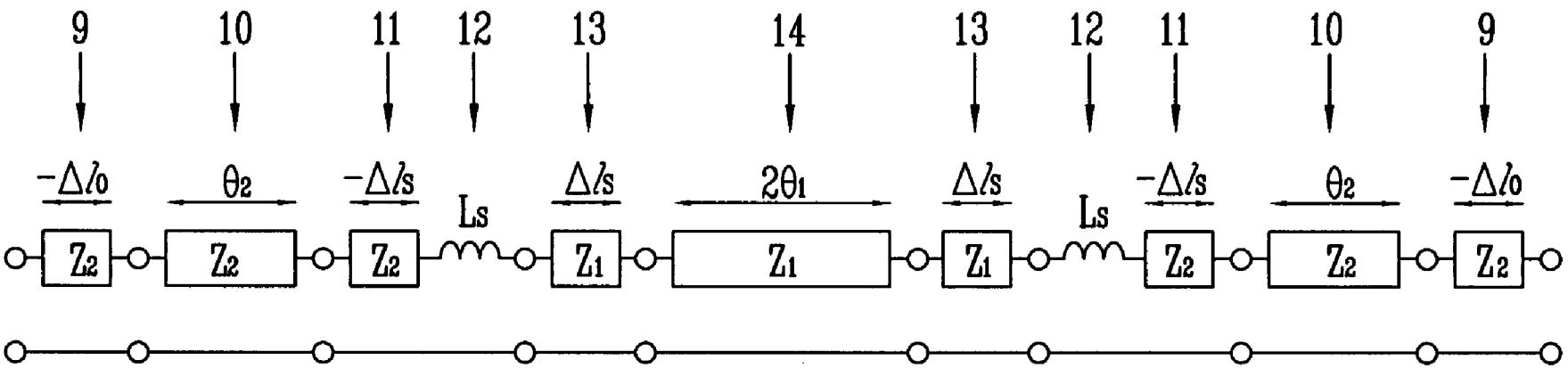

FIG. 4 is an equivalent circuit diagram of the compensated SIRs 7, 8 of FIG. 3. In FIG. 4, for the compensated SIR, the length of the low impedance line $\theta'_2$ is compensated as much as $-\Delta \mathbf{1}_0 \mathbf{9}$, the effect from the open type terminal, and $-\Delta \mathbf{1}_S \mathbf{11}$, the effect from the step, and the length of the high impedance line $\theta'_1$ is compensated as much as $\Delta \mathbf{1}_S \mathbf{13}$, the effect from the step. This value becomes significant as the wavelength is shorter, and it is a critical element in the millimeter wave band. Therefore, when the parasitic component value is taken into account, the resonator changes the length of the low impedance line into $\theta'_2$ and the length of the high impedance line into $\theta'_1$, as indicated in equation 1. Further, $L_S$ 12 or an inductance incurred by the step is negligible.

$$\theta'_1=\theta_1+xl_s,\ \theta'_2=\theta_2-xl_o-xl_S \qquad \text{Equation 1.}$$

Figure 5:
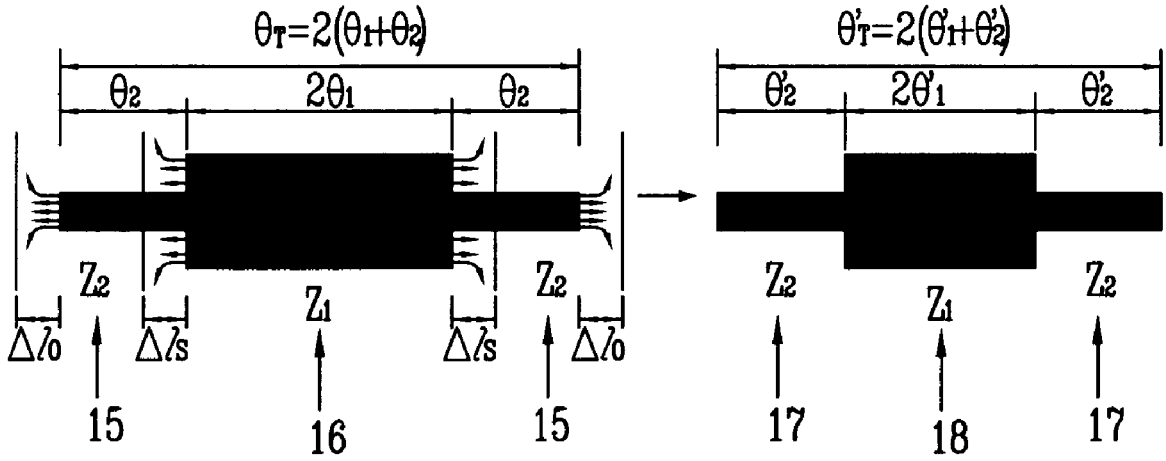

FIG. 5 is a structural diagram for the existing SIRs 15, 16 comprising a high impedance line 15 at the ends and a low impedance line 16 at its center and the compensated SIRs 17, 18 in which the parasitic component value is extracted to compensate the length. In FIG. 5, the existing SIRs 15, 16 have an effect from the open type terminal $\Delta \mathbf{1}_0$, and an effect from the step $\Delta \mathbf{1}_S$. Therefore, the compensated SIRs 17, 18 reduce the length of the high impedance transmission line $\theta'_2$ as much as the effect from the open type terminal $\Delta \mathbf{1}_0$, and increase the length of the high impedance transmission line $\theta'_2$ as much as the effect from the step. And they also reduce the length of the low impedance transmission line $\theta'_1$ as much as the effect from the step $\Delta \mathbf{1}_S$.

Figure 6:
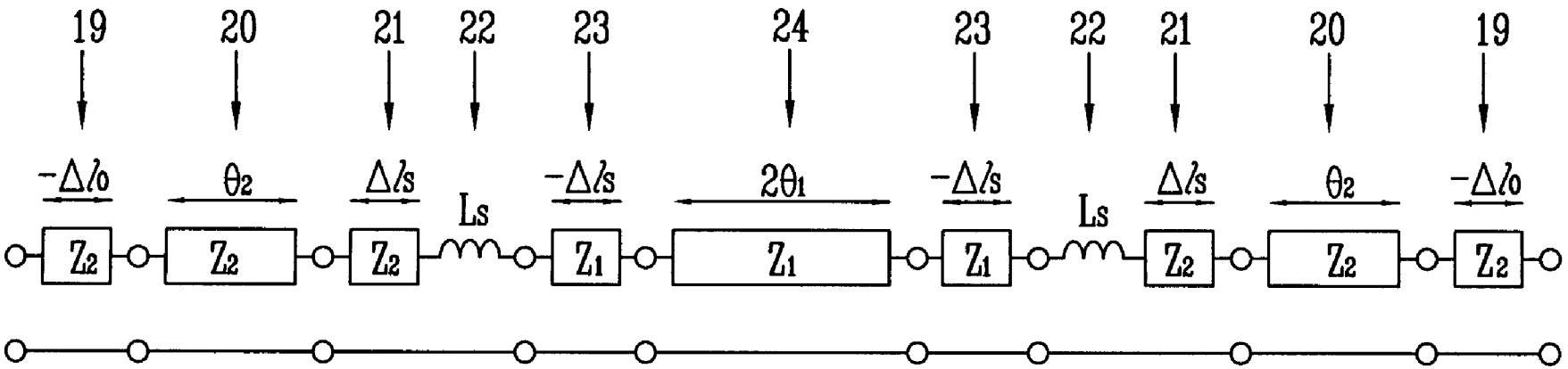

FIG. 6 is an equivalent circuit diagram of the compensated SIRs 17, 18 of FIG. 5. In FIG. 6, for the compensated SIR, the length of the high impedance line $\theta'_2$ is compensated as much as the effect from the open type terminal $-\Delta \mathbf{1}_0 \mathbf{19}$, and as much as the effect from the step $\Delta \mathbf{1}_S$ 21, and the length of the low impedance line $\theta'_1$ is compensated as much as the effect from the step $-\Delta \mathbf{1}_S$ 23. Therefore, when the parasitic component value is taken into account, the resonator changes the high impedance line into $\theta'_2$ and the low impedance line into $\theta'_1$, as indicated in Equation 2. Additionally, $L_S$ 12 or an inductance incurred by the step is negligible.

$$\theta'_1=\theta_1-xl_s,\ \theta'_2=\theta_2-xl_o+xl_S \qquad \text{Equation 2.}$$

Figure 7:
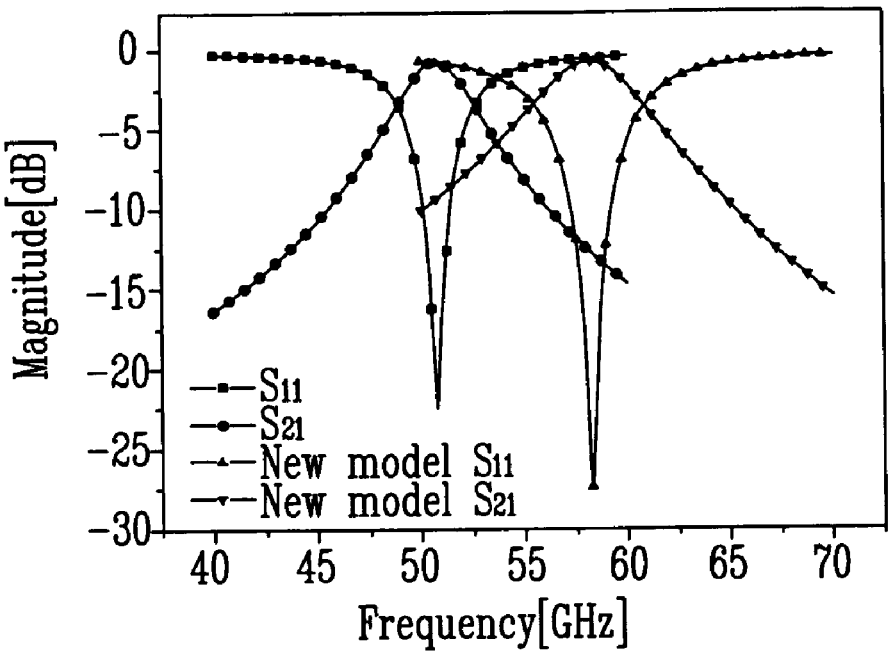
FIG. 7 is a graph showing an experimental result in which S-parameter characteristics $S_{11}$, $S_{21}$ for the case where there is no compensation for a discontinuous component due to the discontinuous structure of an SIR is compared with a new model of the S-parameter characteristics $S_{11}$, $S_{21}$ for the case where there is compensation.

FIG. 7 is a graph showing an experimental result, in which S-parameter(frequency transmission) characteristics $S_{11}$, $S_{21}$ for the case where there is no compensation for a parasitic component due to the discontinuous structure of an SIR is compared with a new model of the S-parameter characteristics $S_{11}$, $S_{21}$ for the case where there is compensation. Here, $S_{11}$ and $S_{21}$ indicates a return loss and an insertion loss, respectively. This experiment designs to have a resonant frequency at a center frequency of 60 GHz, a dielectric constant of 7.4 and a thickness of 0.1 mm. In FIG. 7, in the case where there is no compensation, the SIR has its resonant frequency of 51 GHz, and in the case where compensation is made, the SIR has its resonant frequency of 58 GHz. Therefore, it can be appreciated that more exact design can be obtained using the compensation.

Figure 8:
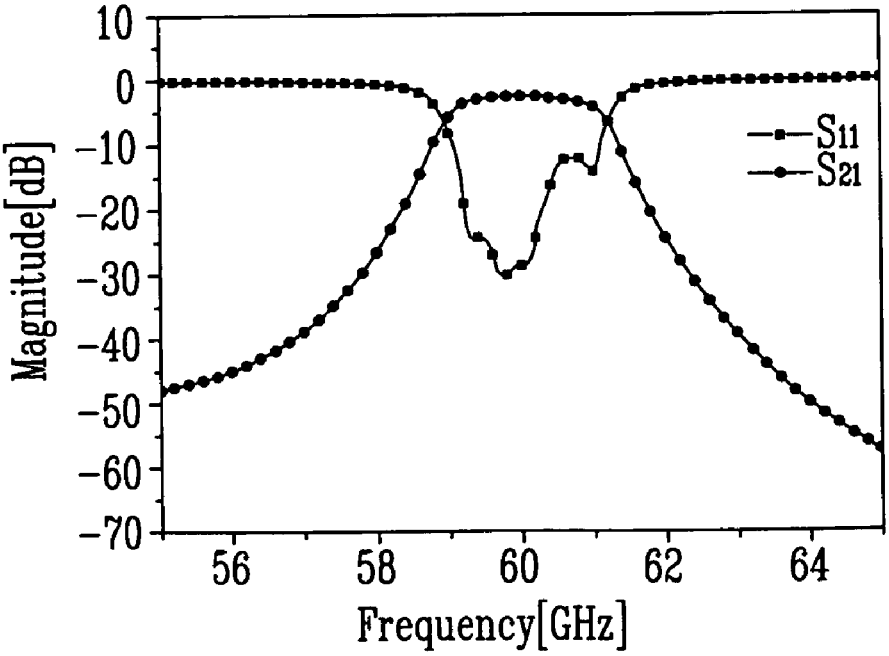
FIGS. 8 and 9 are diagrams for illustrating a fact that a microstrip band pass filter according to a first embodiment of the present invention can be designed to have various center frequencies.
Figure 9:
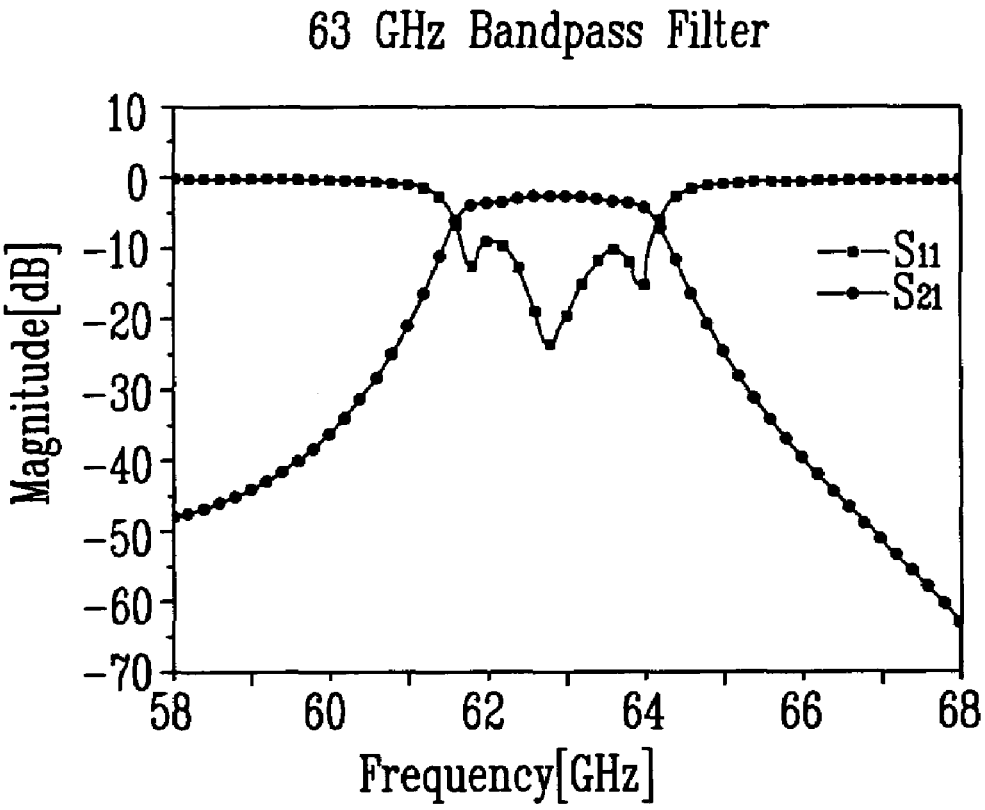

FIGS. 8 and 9 are diagrams for illustrating a fact that a microstrip band pass filter according to a first embodiment of the present invention can be designed to have various center frequencies.

FIG. 8 is a graph showing S-parameter characteristics curves $S_{11}$, $S_{21}$ of the experiment result, in which a microstrip band pass filter according to the first embodiment of the present invention is applied with a 7.4 dielectric constant of the dielectric substrate and a 0.1 mm thickness to make a bandwidth of 1 GHz at a center frequency of 60 GHz and an attenuation characteristic of 40 dB at a sideband frequency of 3 GHz. The return loss $S_{11}$ shows a characteristic less than 10 dB, while the insertion loss $S_{21}$ shows an attenuation characteristic less than 40 dB at the sideband frequency of 3 GHz and an insertion loss of 3 dB at the pass band, and a bandwidth characteristic of about 2 GHz.

FIG. 9 is a graph showing S-parameter characteristics curves $S_{11}$, $S_{21}$ of the experiment result, in which a microstrip band pass filter according to the first embodiment of the present invention is applied with a 7.4 dielectric constant of the dielectric substrate and a 0.1 mm thickness to make a bandwidth of 1 GHz at a center frequency of 63 GHz and an attenuation characteristic of 40 dB at a sideband frequency of 3 GHz. The return loss $S_{11}$, shows a characteristic less than 10 dB, while the insertion loss $S_{21}$ shows an attenuation characteristic less than 40 dB at the sideband frequency of 3 GHz and an insertion loss of 3 dB at the pass band, and a bandwidth characteristic of about 2 GHz.

Figure 10:
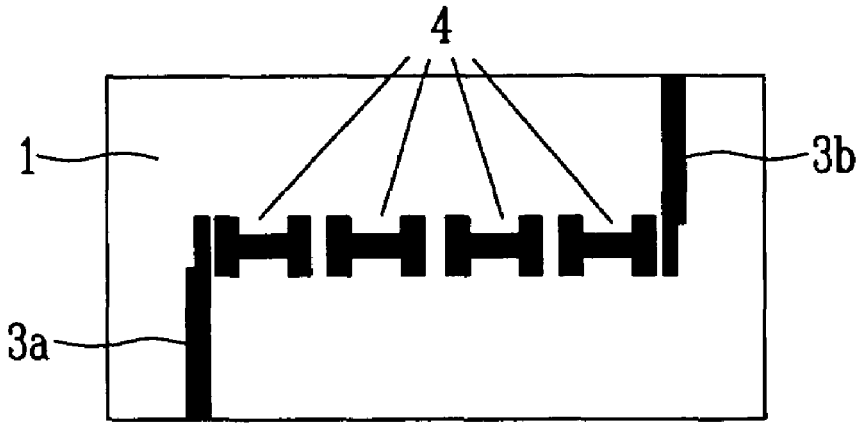
FIGS. 10 to 12 are diagrams for illustrating a microstrip band pass filter according to second to fourth embodiments of the present invention.
Figure 11:
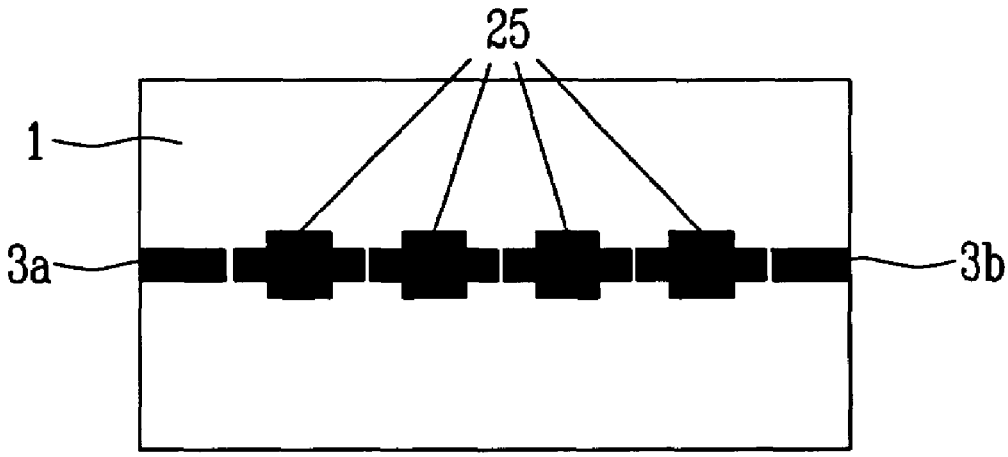
Figure 12:
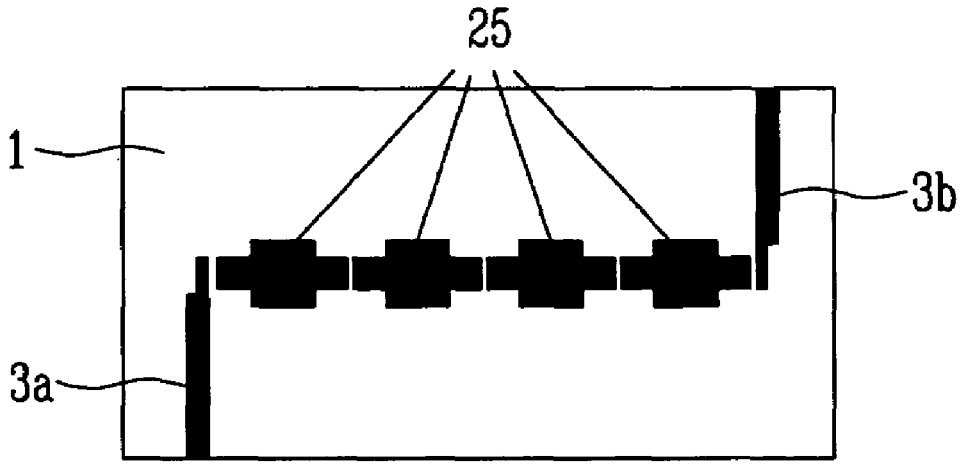

FIGS. 10 to 12 are diagrams for illustrating a microstrip band pass filter according to second to fourth embodiments of the present invention.

FIG. 10 is another arrangement of the input and output terminal 3*a*, 3*b* in the microstrip band pass filter according to the first embodiment of the present invention. That is, the shape of the gap between the input terminal 3*a* and the first SIR and the shape of the gap between the last SIR and the output terminal 3*b* for the microstrip band pass filter according to the second embodiment of the present invention remain the same as the microstrip band pass filter according to the first embodiment, while the wiring of the input terminal 3*a* and the wiring of the output terminal 3*b* are arranged perpendicular to a coupling direction of the SIR 4.

FIGS. 11 and 12 show still another arrangement of the SIR in the microstrip band pass filter according to the first and the second embodiments of the present invention. For the microstrip band pass filter according to the first and second embodiments of the present invention, the SIR comprises a high impedance transmission line arranged at its center and a low impedance transmission line arranged at both ends, while for the microstrip band pass filter according to the third and fourth embodiments of the present invention, the SIR 25 comprises a low impedance transmission line arranged at its center and a high impedance transmission line arranged at both ends.

Although the subject matter of the present invention has been described in detail with reference to the preferred embodiments, it should be noted that these embodiments are for illustrative only, not for restrictive. Further, those skilled in the art will appreciate that a variety of modifications will be made within the scope of the present invention.

A microstrip band pass filter using end-coupled SIRs according to the present invention has a good attenuation characteristic and a narrowband characteristic, and is insensitive to the manufacturing error, and advantageously, a fine frequency transition can be made without distortion of the filter characteristic just with width adjustment of the low impedance line of the SIR.

Further, for the microstrip band pass filter using the end-coupled SIRs according to the present invention, a parasitic component value due to the discontinuous structure of the SIR is extracted using an analysis theory for the existing discontinuous structure, to increase or reduce the length of the resonator for compensation, thus having a merit that various frequency ranges are applicable with improved design accuracy.

What is claimed is:

1. A microstrip band pass filter comprising:

a dielectric substrate;

a conductor plate located on a lower surface of the dielectric substrate; and an input terminal, a plurality of SIRs, and an output terminal located on an upper surface of the dielectric substrate in series, wherein the input terminal, the plurality of SIRs and the outputs terminal are conductors and end-coupled through gaps; and wherein each of the plurality of SIRs is a three step SIR with a low impedance line at both ends and a high impedance at its center or a three step SIR with a low impedance line at its center and a high impedance line at both ends; and wherein a length of a low impedance transmission line and a length of a high impedance transmission line for the SIR are adjusted to compensate for a parasitic component of a discontinuous structure.

2. The microstrip band pass filter according to claim 1, wherein directions of a line of the input terminal and a line of the output terminal are the same as that of the SIR arrangement, or perpendicular to that of the SIR arrangement.

* * * * *